US007102587B2

(12) United States Patent
Benton et al.

(10) Patent No.: US 7,102,587 B2
(45) Date of Patent: Sep. 5, 2006

(54) EMBEDDED ANTENNA CONNECTION METHOD AND SYSTEM

(75) Inventors: Larry D. Benton, Waco, TX (US); Robert R. Krebs, Georgetown, TX (US)

(73) Assignee: Premark RWP Holdings, Inc., Wilmington, DE (US)

( * ) Notice: Subject to any disclaimer, the term of this patent is extended or adjusted under 35 U.S.C. 154(b) by 69 days.

(21) Appl. No.: 10/867,599

(22) Filed: Jun. 15, 2004

(65) Prior Publication Data

US 2005/0275600 A1 Dec. 15, 2005

(51) Int. Cl.
*H01Q 1/40* (2006.01)

(52) U.S. Cl. ..... 343/873; 343/860
(58) Field of Classification Search ..... 343/873, 343/700 MS, 741, 745, 866, 860
See application file for complete search history.

(56) References Cited

U.S. PATENT DOCUMENTS

| | | | | |
|---|---|---|---|---|
| 4,089,003 | A * | 5/1978 | Conroy | 343/700 MS |
| 4,835,538 | A * | 5/1989 | McKenna et al. | 343/700 MS |
| 5,977,927 | A * | 11/1999 | Mandai et al. | 343/788 |
| 5,995,047 | A * | 11/1999 | Freyssinier et al. | 343/700 MS |
| 6,064,351 | A * | 5/2000 | Mandai et al. | 343/873 |
| 2004/0192226 | A1 * | 9/2004 | Luen | 455/90.1 |

* cited by examiner

*Primary Examiner*—Tan Ho
(74) *Attorney, Agent, or Firm*—Fletcher Yoder

(57) ABSTRACT

A technique is provided for interconnecting an embedded antenna with external circuitry. The antenna may be formed on an intermediate layer of a layered structure, such as a laminate. The interconnection may be made by providing an aperture through the laminate structure and a terminal pad of the antenna, and making a physical connection by means of a fastener or similar structure extending through the laminate structure. A conductive fluid or other intermediary material such as epoxy may be provided between the fastener and the embedded antenna terminal pad. Similar connection may be made by capacitive coupling with a terminal pad on an exterior surface of the laminate structure.

33 Claims, 3 Drawing Sheets

EMBEDDED ANTENNA CONNECTION METHOD AND SYSTEM

BACKGROUND

The present invention relates generally to the field of embedded antennas, such as those used to receive radio frequency (RF) signals. In particular, the invention relates to a novel technique for connecting an embedded antenna to remote circuitry, such as for receiving and processing signals from RF tags, and other signals sources.

A growing number of applications make use of wireless antenna for receiving signals from a variety of sources. A number of such applications involve the use of RF sources, tags, antenna and associated circuitry for detecting the presence of, or communicating data to and from remote devices with radio frequency electromagnetic waves. For example, in a growing number of inventory and material handling applications, passive RF tags are placed on components, including the components themselves, packaging, and associated documentation. The RF tags are capable of identifying the components when the component is placed within a desired or specific range of an RF antenna. The source of the data may also be an active source, such as a powered computer chip or other device. In general, the antenna is specifically designed, such as by the choice of materials and geometries to tune its electromagnetic properties to the frequency of the source. Thus, once properly tuned, the antenna can detect, send and receive signals at the desired frequency.

A challenge in implementing radio frequency wireless systems is in the design of the antenna, and the placement of the antennae in the systems. For example, advancements have been made in the formation of embedded antenna, such as antennae used in decals, labeling, and even within laminated or multi-layer structures. In certain applications, where the antenna is at an upper-most location in packaging, the connection of transmitting/receiving circuitry to the antenna does not pose a particular problem. However, where an antenna is embedded in a multi-layer structure, connection to the antenna becomes problematic.

Circuitry coupled to passive antennae, such as RF antenna, may include various filtering, impedance matching, and sensing circuitry. For example, depending upon the antenna design, the precise frequency matched to the antenna may need to be tuned, such as by the use of tuning capacitors. Signals received by the antenna, and passed through the tuning circuitry, may be further filtered, digitized, amplified, or otherwise processed to convert the signal to a useable form. Ultimately, the received or transmitted signals originating from or applied to specialized circuitry and systems, such as to monitor the presence, number, placement, and other parameters related to the particular components to which the RF tags or senders are secured must be coupled to a resonant antenna.

There is, at present, a particular need for techniques for interfacing or connecting embedded antenna, such as RF antennae with external circuitry. One such need exists in the field of laminated structures, in which embedded antennae can be formed on one of the laminated layers, and the antennae interfaced with filtering, impedance matching, amplification, or other data acquisition circuitry by means of a simple and reliable interconnection.

BRIEF DESCRIPTION

The present invention provides a novel approach to connecting an embedded antenna to a remote circuitry designed to respond to such needs. While the technique may find application in a wide range of settings, it is particularly well-suited to interfacing an antenna embedded in a laminated structure with external circuitry. The laminated structure may be one of a variety of types of structures, including any multi-layer material, and particularly phenolic-impregnated and/or melamine-impregnated cellulosic materials. Moreover, the present technique may used with a variety of types of antennae. For example, in a presently contemplated embodiment, an antenna is formed by printing a conductive material on a layer destined to form an embedded layer in a laminate structure. Other types of antenna may include metal structures, thin films, foils, and so forth. Similarly, the antenna and interconnect structure may be adapted for sending and receiving various frequencies of signals, such as one or more frequencies in an RF range.

In accordance with one aspect of the present technique, a connection system for interfacing an embedded antenna with remote circuitry includes a conductive element extending from an exterior surface of a multi-layer material. The connection system extends through at least a portion of the multi-layer material and through a portion of the embedded antenna. The conductive element is also in electrical continuity with the portion of the embedded antenna to transmit signals to or from the embedded antenna during operation.

The invention also provides an embedded antenna system. The system includes a multi-layer material, such as a laminate, an embedded antenna, and a conductive element. The multi-layer material includes a plurality of interior surfaces and an exterior surface. The embedded antenna is disposed intermediate two of the interior surfaces, and has a terminal pad. The conductive element extends from the exterior surface of the multi-layer material through at least a portion of it. The conductive element also extends through the terminal pad of the embedded antenna. The conductive element being in electrical continuity with the terminal pad of the embedded antenna to transmit signals to or from the embedded antenna during operation.

The invention also provides a method for transmitting signals between an antenna embedded in a multi-layer material and external circuitry. According to certain aspects of the method, an aperture is formed in the multi-layer material from an exterior surface thereof. The aperture extends at least through a terminal area of the embedded antenna. A conductive terminal element is inserted into the aperture to place the terminal element in electrical continuity with the antenna.

DRAWINGS

These and other features, aspects, and advantages of the present invention will become better understood when the following detailed description is read with reference to the accompanying drawings in which like characters represent like parts throughout the drawings, wherein.

Figure 5:
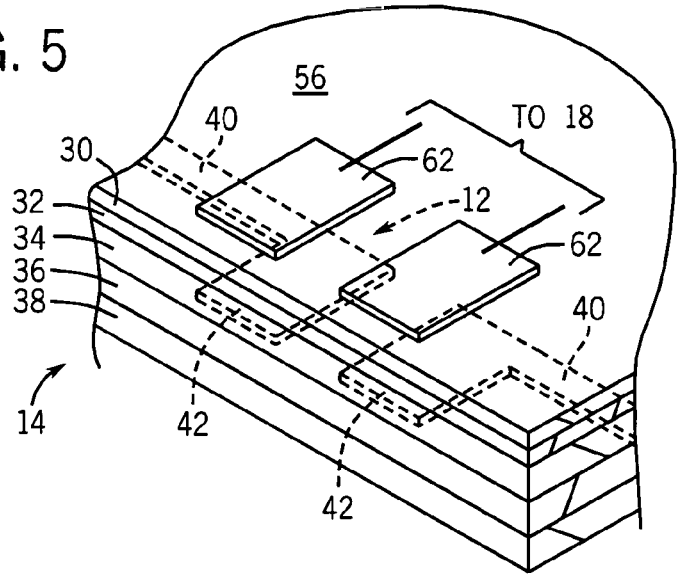
FIG. 5 is a partial prospective view of an alternative configuration in accordance with the present technique, in which interconnection with an embedded antenna is accomplished by capacitive coupling.
Figure 6:
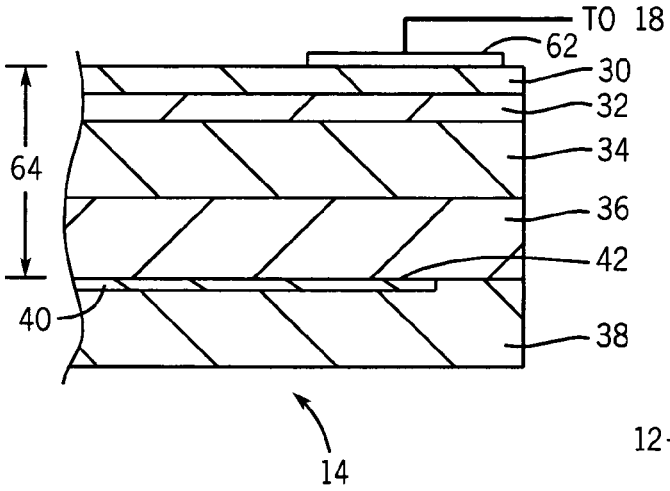
Figure 7:
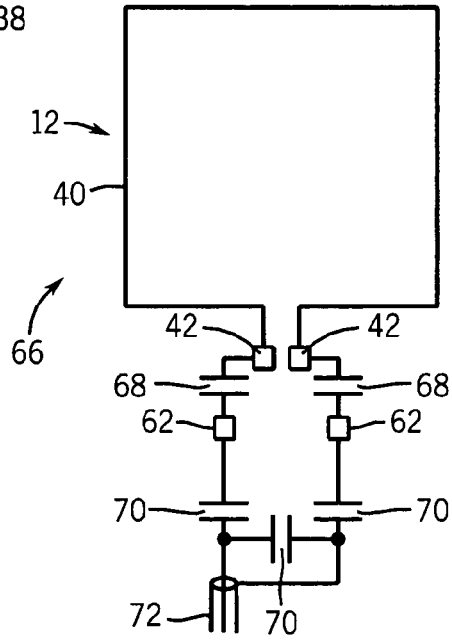

FIG. 6 is a partial sectional view through the structure of FIG. 5 illustrating the placement of the interconnect components with respect to pads in the antenna; and FIG. 7 is a diagrammatically representation of an exemplary circuit established for the capacitive coupling arrangement of FIGS. 5 and 6, and illustrating an exemplary manner in which the signals may be acquired from the interconnect system.

DETAILED DESCRIPTION

Figure 1:
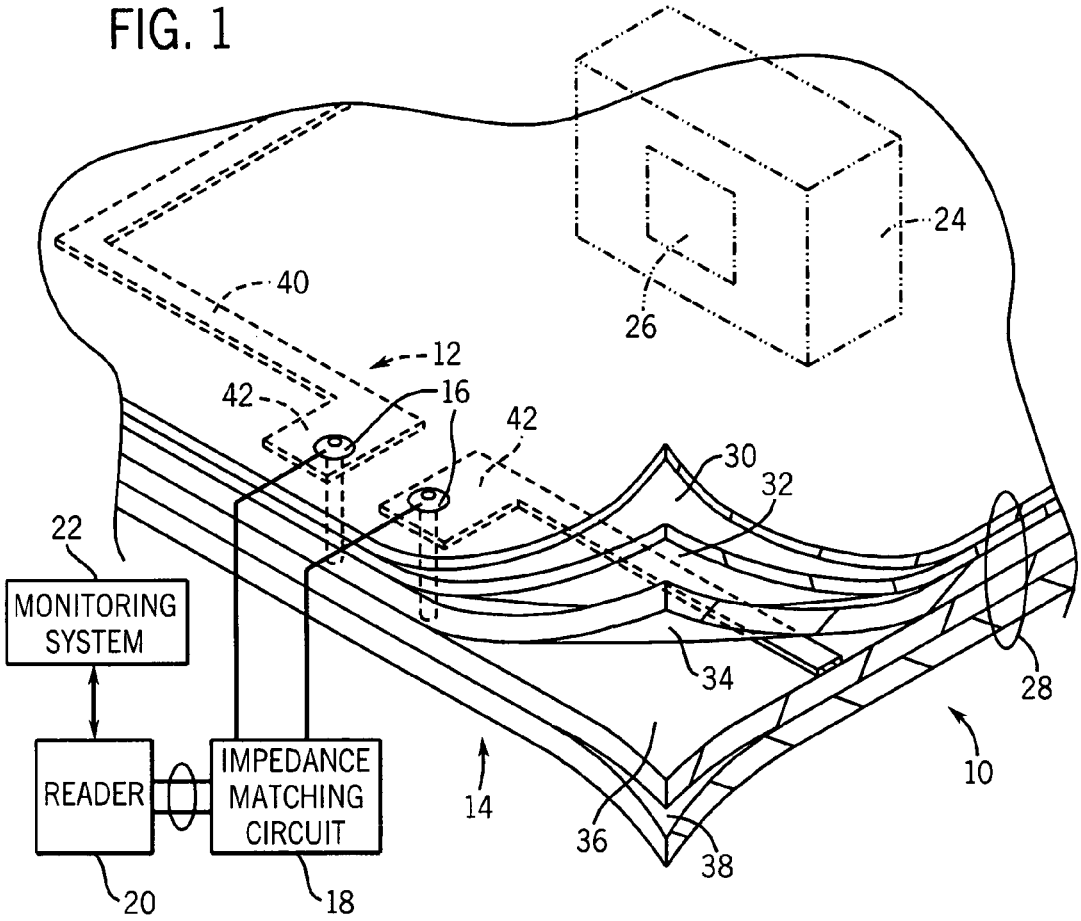
FIG. 1 is a partial prospective view of a laminate system in which an RF identification system is installed along with interconnect structures for applying and receiving signals to and from the antenna.

Turning now to the drawings, and referring first to FIG. 1, a signal sensing system, in the form of a radiofrequency identification (RFID) system 10 is illustrated as including an antenna 12 embedded in a laminate 14. While an RFID system is illustrated in the figures, it should be borne in mind throughout the present discussion that the interconnection techniques described herein may be applied to RFID systems, and other systems both for identification and other purposes, operating at radiofrequencies, as well as at other frequencies. The system illustrated the present figures, for example, is specifically designed to operate at particular target frequencies, such as 915 MHz or 13.56 MHz. However, other frequencies, including frequencies outside the radiofrequency range may be envisaged. Moreover, based upon tuning, materials, and other geometries, and other factors, the operating ranges or sensitivities of the antenna may be specifically adapted, such as to broaden or narrow the range of sensitivity.

In the embodiment illustrated in FIG. 1, the interconnect system includes terminals 16 which penetrate through the laminate 14, and where desired, into a substrate beneath the laminate as described in greater detail below. More will be described regarding the terminals and their preferred construction below. The terminals 16 are coupled to external circuitry, such as to an impedance matching circuit 18 which tunes the antenna 12 to the desired frequency or frequency range. The impedance matching circuit 18 may be coupled to further circuitry, such as to a reader 20. In general, the reader 20 may be situated locally to the antenna, or remotely, and may perform a variety of functions. For example, the reader may filter signals sent to or received from the antenna via the terminals 16, or may perform functions such as converting signals between analog and digital formats, and even recognition of signals or interpretation of data. In a typical system, the reader 20 may be further coupled to a monitoring system 22. The monitoring system 22 may be part of a larger object monitoring scheme, such as for inventory management, object location, control of pilfering, and so forth.

Again as illustrated in FIG. 1, objects, as illustrated generally at reference numeral 24, may bear active or passive tags, such as an RF tag 26. As will be appreciated by those skilled in the art, the tags may store data which can be provided to the reader and monitoring system in response to excitation by the antenna. Alternatively, certain tags or other devices may be provided on or within the objects 24 to actively send signals that are sensed by the antenna. In certain applications, the tags are sensed within specific locations, such as within the bounds or immediately adjacent to the antenna. In other applications, and depending typically upon the frequency of the system, the tags may respond to signals quite distant from the antenna.

Figure 2:
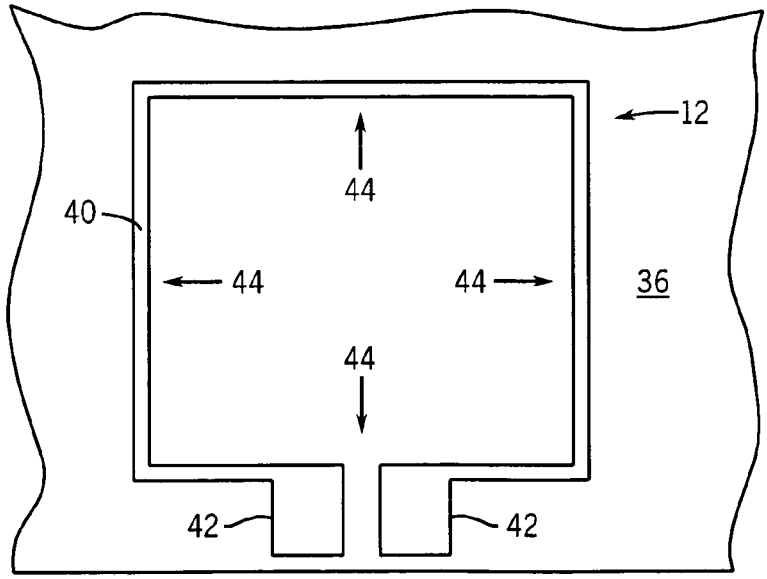
FIG. 2 is a partial plan view of an exemplary antenna, in this case a RF antenna, to which connections may be made in accordance with the present technique.

The embodiment illustrated in FIG. 1 includes an antenna that is embedded in a laminate 14. In this illustrated embodiment, the laminate 14 includes multiple layers as indicated generally by reference numeral 28. In a typical laminate structure, which may be a high pressure or low pressure laminate, multiple layers 28 may include a melamine impregnated layer 30, such as for resisting abrasion or wear, as well as one or more decorative layers 32. The layers 30 and 32 may both be impregnated with melamine, or one of the intermediate layers may be impregnated with melamine and a phenolic resin. In the illustrate embodiment, the laminate further includes a series of phenolic impregnated kraft layers 34, 36 and 38. The antenna 12 is formed on one surface of one of these layers, particularly on layer 36 in the illustrated embodiment. The antenna may be formed in one of a variety of manners, as discussed in greater detail below. In general, in the illustrated embodiment, the antenna is formed of a conductive ink, paint or other fluid that forms a trace 40 defining the periphery of the antenna. Antenna terminal pads 42 are formed at extremities of the antenna trace 40. As will be appreciated by those skilled in the art, the antenna may be formed at other locations in the multilayer structure, including on top sides, bottom sides, and at various locations in the layer stack. Similarly, the present interconnect techniques may be employed with other structures then impregnated cellulosic materials. Such materials might include, without limitation, plastics, thin films, sheet materials, glass layers, wood layers, and so forth. FIG. 2 illustrates an exemplary antenna layout such as may be imprinted on the phenolic impregnated kraft layer 36 illustrated in FIG. 1. As shown in FIG. 2, the antenna trace 40 forms the antenna itself, generally extending over an area 44. As will be appreciated by those skilled in the art, the dimensions of the area 44 and the particular configuration of the trace 40 forming the antenna will vary with the materials surrounding the antenna, and particularly with the frequency and frequency range for which the antenna is designed. Moreover, the antenna may generally be formed as a single or multiple traces, such as traces that may extend parallel to one another over the area 44. The trace or traces are contiguous with the antenna terminal pads 42 which may be made of the same material as the antenna. As noted above, rather than printing as in the presently contemplated embodiment, the antenna, the trace, and/or the terminal pads 42 may be formed of other materials, such as films, foils, and so forth.

Figure 3:
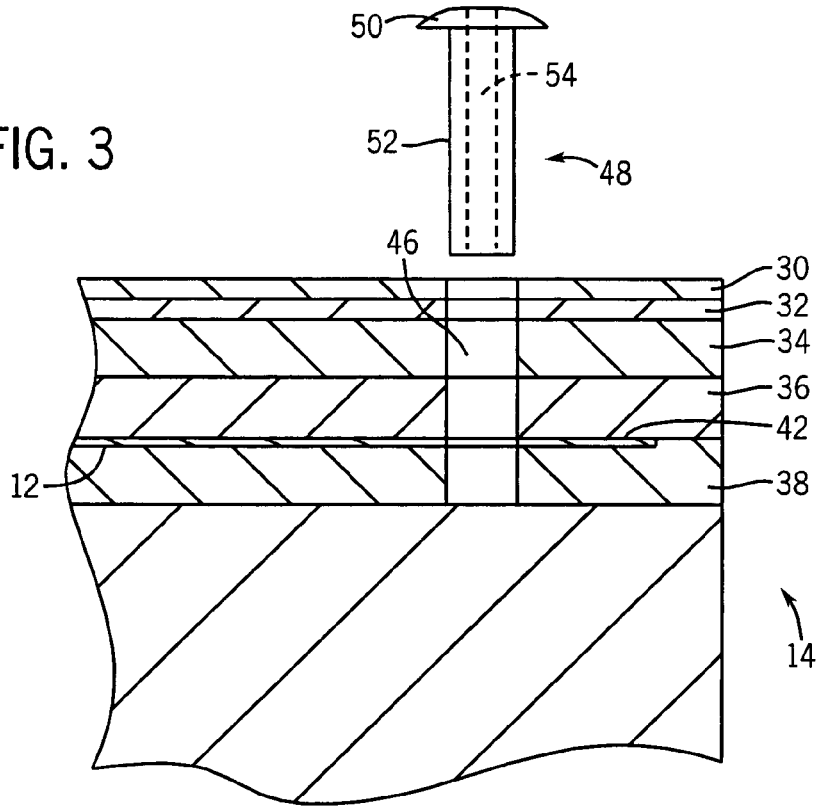
FIG. 3 is a partial sectional view through a laminate structure in which an antenna is formed, and illustrating a connection or terminal element prior to installation in the material in accordance with an aspect of the present technique.

FIG. 3 shows the interconnect system illustrated in FIG. 1 in partial section. In the embodiment illustrated in FIG. 3, the multi-layer laminate 14 is shown with a number of internal layers as described in detail with reference to FIG. 1 above. An aperture 46 is formed through the layers, and may penetrate into a substrate or base to which the laminate structure is secured. Although not illustrated in FIG. 3, for example, a wood, plywood, MDF, or other substrate may be provided for the laminate, with the laminate being secured thereto by adhesive. Where such a substrate is provided, it may be preferred to extend aperture 46 into the substrate below the laminate structure. The terminal itself, in the illustrated embodiment of FIG. 3, comprises a rivet 48, such as an aluminum pop-rivet, having a head 50 and a shank 52. A hole or aperture through the rivet 48 permits the rivet to be expanded once installed in the aperture 46. The dimensions of the aperture 46 and the shaft 52 of the rivet are such that the rivet can be easily inserted into the aperture, leaving a slight space for a conductive material there between as described below. In general, the head 50 of the rivet may be configured to rest atop the laminate structure or the laminate structure may be countersunk to receive the rivet, with the head then being configured to fit flush or even below the top of the laminate following installation.

Figure 4:
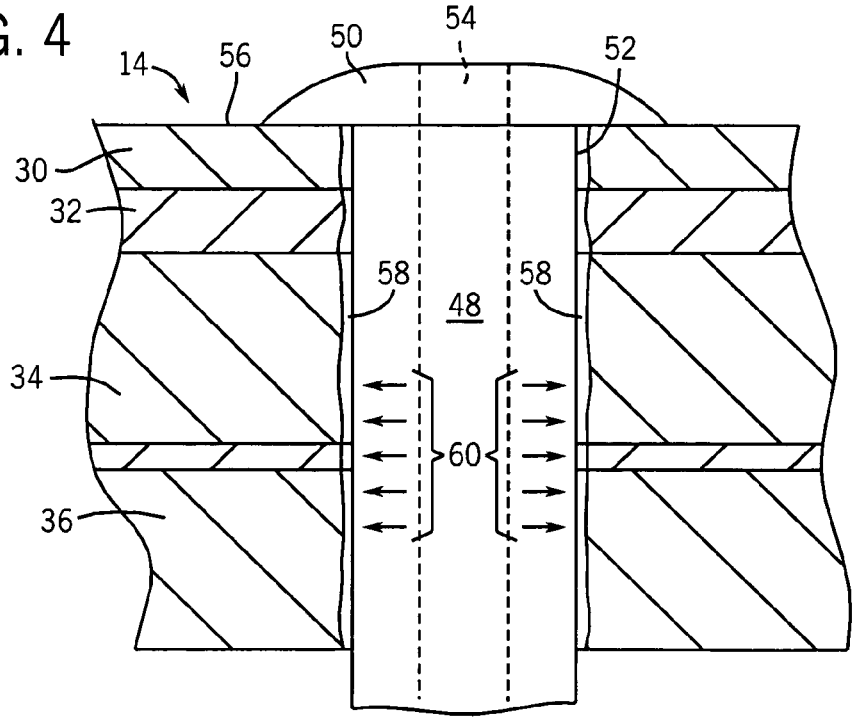
FIG. 4 is a detail view of a portion of the system shown in FIG. 3, with the terminal element installed to complete an interconnection between the embedded antenna and external circuitry.

Referring to FIG. 4, the structure illustrated in FIG. 3 is shown in somewhat greater detail. In the illustration of FIG. 4, the rivet 48 has been installed and expanded outwardly toward the periphery of the aperture. As noted above, in the particular configuration illustrated, the head 50 of the rivet rests against the top surface 56 of the laminate 14. Prior to insertion of the rivet in the aperture, however, a conductive material, such as a conductive epoxy illustrated at reference numeral 58, is inserted either within the aperture, around the shank of the rivet, or in both of these locations. Following installation, and preferably following expansion of the terminal rivet, a force is exerted by the rivet against the conductive epoxy 58 and thereby against the periphery of the aperture that both secures the rivet in place, and facilitates electrical contact between the terminal rivet and the embedded antenna terminal pad.

Many alternative structures and materials may be envisaged to accomplish the interconnection described above with reference to FIGS. 3 and 4. In a presently contemplated embodiment, for example, a silver-conductive epoxy commercially available from ITW Chemtronics under the commercial designation CW2400 is used. The epoxy is applied both to the terminal rivet and to the inner periphery of the aperture prior to insertion of the rivet therein. Alternative conductive materials might include a conductive grease available from ITW Chemtronics under the commercial designation CW7100. As will be apparent to those skilled in the art, other conductive members may also be used, such as screws, pins, hollow cylinders and sleeves, and so forth. In a present embodiment, the shank of the terminal rivet 48 has an outer dimension of 0.125 inches, with the aperture being oversized by 0.020 inches. It should also be noted that depending upon the application, the fastener itself may be applied to complete the connection with the antenna without the need for an intermediary material. However, it has been found that excellent reliability can be obtained through use of the intermediate material described herein.

FIGS. 5 and 6 illustrate an alternative configuration for an interconnect connect structure in accordance with aspects of the present technique, that makes use of capacitive coupling between antenna terminal pads 42 of the embedded antenna and terminal pads placed on an exterior surface of the laminate structure. As shown in FIG. 5, the antenna terminal pads 42 are positioned beneath the capacitive coupling pads 62, and both pads may be of a similar size and configuration. For example, in a present embodiment, both pads are approximately 2"×2" (5 cm×5 cm) in size. The capacitive coupling pads 62 may be made of any suitable material, such as a copper tape adhesively secured to the surface of the laminate stack. As will be appreciated by those skilled in the art, certain of the configurations of the terminal pads and the capacitive coupling pads 62 may make one or the other of the systems described above more advantageous. For example, at lower operating frequencies, higher capacitances, and thus larger areas may be required for the capacitive coupling configuration. Thus, the configuration may be more suitable for such higher frequencies.

FIG. 7 illustrates an exemplary equivalent circuit for the capacitive coupling embodiment of FIGS. 5 and 6. As shown in FIG. 7, the antenna 12, formed of one or more traces 40, terminates in antenna terminal pads 42. Capacitive coupling pads 62 which overlie these antenna terminal pads as discussed above, effectively form capacitors 68 through the intermediary of the laminate structure lying between the antenna terminal pads 42 and the capacitive coupling pads 62, which acts as a dielectric. Conductors may then be secured to the capacitive coupling pads 62 and these conductors routed to an impedance matching network comprised of a series of capacitors 70. Capacitors 70 serve to tune the resonant frequency of the antenna to the desired frequency or frequency range. Conductors coupled to the network of capacitors 70 may then be coupled to inner and outer conductors of a coaxial cable 72 which is routed to the external circuitry, such as the reader 20 discussed above with reference to FIG. 1. It should be noted that the impedance matching circuit 18 discussed above with reference to FIG. 1 may take up form similar to that illustrated in FIG. 7, including capacitors 70 coupled to a coaxial cable 72.

Although references made in the present discussion of a tuning circuit, depending upon the frequency, such tuning circuits may not be required. For example, in two presently contemplated frequency bands, a first at 13.56 MHz, and second at a higher 915 MHz, the tuning circuit for impedance matching, may be required only in the 13.56 MHz range. As will be apparent to those skilled in the art, the particular antenna configuration will depend upon the desired usage, with the lower frequency band generally providing localization within smaller volumes. Moreover, additional applications and frequency ranges may be envisaged, both for the antennas described above and for the interconnect system of the present technique. Thus, the present technique may be adapted to various wireless networks, WI-FL applications, and so forth.

Examples of the foregoing structures were constructed that performed very well in the intended applications. Although an aluminum rivet was used in practice, more generally, any suitable conductive member may be employed for the terminals, particularly materials that provide low electrical resistance. Suitable materials may include aluminum, copper, brass, and so forth. The material preferably provides a good corrosion resistance, and in the embodiment in which silver-based conductive adhesives were used, the material preferably has a minimal bimetallic corrosion with silver. As noted above, in a present embodiment, the fastener is cold formable as to create hydraulic pressure on an intermediary fluid disposed between the fastener and the edges of the antenna during installation.

The procedure for installation of the system included location of the terminal ends of the antenna within the laminate. This may be accomplished by various methods, such as backlighting the laminate with a lamp to reveal the location of the antenna trace or the terminal pads. In certain applications, the antenna or terminal pads may be visible by surface deviations in the laminate or film or sheet material. Subsequently, the laminate structure may be applied to or mounted to an appropriate substrate, such as MDF, particle board, plywood, or any other suitable substrate. Subsequently, the aperture in which the fastener was fixed was drilled slightly (e.g. 0.005 to 0.010 inches; 0.125 mm to 0.250 mm) larger than the diameter of fastener. In the embodiment constructed, a 0.125" (3 mm) fastener was then inserted into the aperture. Prior to insertion into the aperture, the shank of the fastener was coated with the conductive adhesive described above and the assembly was pressed together. In the case of a pop rivet, a pop rivet tool was used to expand the shank of the rivet in the hole, thereby forcing the conductive adhesive into cracks and crevices in the hole and completing electrical contact with the antenna pads. As noted above, where desired, the aperture and rivet or other fastener can extend completely through the laminate and into the underlying substrate. In should be noted that where an intermediate connection, such as to a printed circuit board, is desired, prior to the step of coating the terminal fastener with conductive material, the head of the fastener may be coated with a similar conductive adhesive and the fastener pressed into the printed circuit board. The head of the fastener then makes physical and electrical contact with the conductive traces of the circuit board as well as with the antenna pad underlying it. Again, other fasteners might include screw fasteners, and so forth.

Four exemplary antennae were made and tested to determine durability of the method for providing the connection described above. Variations of the technique included the following:

Sample Series 1—silver ink antenna, no copper antenna pad, conductive adhesive;

Sample Series 2—same as sample series 1;

Sample Series 3—copper strip laid over silver ink antenna conductive adhesive; and Sample Series 4—same as sample series 3.

The evaluation of the samples was made based upon testing for the complex impedance of the antenna. The real component of the complex impedance is the resistance of the antenna. The imaginary component of the complex antenna is the reactive component of the impedance. Table 1 below summarizes the complex impedance data collected over a 3 week aging period for the conductive adhesive at room temperature. The characteristic impedance for all 4 sample series were close enough that the capacitive matching network built for sample series 1 was capable of matching each antenna to a 50 Ω impedance source.

TABLE 1

Summary of Complex Impedance/Aging Data

| Sample ID | Date | Complex Impedance | Inductance (μH) |
|---|---|---|---|
| Sample 1 | Day 1 | 6.59 + 146.09j | 1.72 |
| | Day 2 | 5.51 + 141.77j | 1.66 |
| | Day 7 | 4.51 + 142.29j | 1.67 |
| | Day 28 | 7.06 + 144.74j | 1.71 |
| Sample 2 | Day 1 | 3.43 + 143.86j | 1.69 |
| | Day 2 | 3.25 + 144.25j | 1.69 |
| | Day 3 | 5.09 + 143.62j | 1.69 |
| | Day 7 | 4.48 + 144.05j | 1.69 |
| | Day 28 | 6.00 + 144.05j | 1.69 |
| Sample 3 | Day 1 | 5.81 + 144.24j | 1.70 |
| | Day 2 | 5.18 + 142.16j | 1.67 |
| | Day 7 | 6.20 + 143.77j | 1.70 |
| | Day 28 | 5.43 + 141.98j | 1.67 |
| Sample 4 | Day 1 | 6.98 + 144.7j | 1.70 |
| | Day 2 | 5.40 + 139.80j | 1.64 |
| | Day 7 | 6.01 + 143.68j | 1.69 |
| | Day 28 | 5.80 + 141.05j | 1.66 |

The capability of the rivet method of attaching to the antenna was also tested for durability to withstand thermal shock and cycling. The samples were conditioned in an environment chamber at 22° C. and 70% relative humidity for 48 hours. The samples were then moved to a 25° C., ambient relative humidity environment overnight. The samples were then again moved to a 70° C., ambient relative humidity oven overnight. The cycle was repeated. The DC resistance was then measured and used as a basis of comparison. Table 2 below summarizes the results of these tests.

TABLE 2

Thermal Shock and Cycling Resistance Data

| Sample ID | 22° C. @ 70% RH | After 2 Cycles @ 25° C. | After 2 Cycles @ 70° C. |
|---|---|---|---|
| Sample 1 | 0.89Ω | 0.77Ω | 1.01Ω |
| Sample 2 | 0.91Ω | 0.79Ω | 1.03Ω |
| Sample 3 | 0.65Ω | 0.57Ω | 0.75Ω |
| Sample 4 | 0.89Ω | 0.78Ω | 1.01Ω |

Another antenna series was used to investigate the affect of having the intermediary conducting fluid in the connection. The DC resistance was measured across the various combinations of three rivets at each antenna terminal. That is, three rivets were provided on a left-hand terminal and three rivets on a right-hand terminal. A total of nine measurements resulted from the various permutations. An acceptable connection was deemed to be established if a resistance of less than 2 Ω total DC resistance was measured (i.e. the combined antenna and connection resistance). Tables 3 and 4 summarize the data collected with and without a conductive fluid or intermediary.

TABLE 3

DC Resistance Without Conductive Fluid

| Rivet ID | 1 Right | 2 Right | 3 Right |
|---|---|---|---|
| 1 Left | 1.62Ω | 1.69Ω | 6.92Ω |
| 2 Left | 1.09Ω | 1.67Ω | 6.72Ω |
| 3 Left | 3.38Ω | 3.65Ω | 7.96Ω |

TABLE 4

DC Resistance With Conductive Fluid

| Rivet ID | 1 Right | 2 Right | 3 Right |
|---|---|---|---|
| 1 Left | 0.46Ω | 0.46Ω | 0.46Ω |
| 2 Left | 0.46Ω | 0.46Ω | 0.46Ω |
| 3 Left | 0.51Ω | 0.46Ω | 0.48Ω |

The presence of the conductive fluids significantly reduced the contact resistance of the rivet connection. Dry connections had a greater than 50% failure rate, while connections with fluid had no failures. A conductive intermediary fluid such as silver conductive grease or silver conductive adhesive, of the types described above is believed to provide satisfactory results.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for transmitting signals to or from an antenna embedded in a multi-layer material, comprising:

a conductive element extending from an exterior surface of the multi-layer material through at least a portion of the multi-layer material and through a portion of the embedded antenna, the conductive element being in electrical continuity with the portion of the embedded antenna to transmit signals to or from the embedded antenna during operation; and a conductive layer extending along the conductive element intermediate the conductive element and the portion of the antenna to place the conductive element and the portion of the antenna in electrical continuity.

2. The system of claim 1, wherein the conductive layer comprises a conductive epoxy.

3. The system of claim 1, wherein the conductive element extends completely thorough all layers of the multi-layer material.

4. The system of claim 1, wherein the conductive element is expandable to exert a pressure against the multi-layer material when installed therein.

5. The system of claim 1, wherein the conductive element is hollow.

6. An embedded antenna system comprising:

a multi-layer material including a plurality of interior surfaces and an exterior surface, wherein the multi-layer material is a laminate comprising at least one phenolic impregnated layer and at least one melamine impregnated layer;

an embedded antenna disposed intermediate two of the interior surfaces, the antenna having a terminal pad; and a conductive element extending from the exterior surface of the multi-layer material through at least a portion of the multi-layer material and through the terminal pad of the embedded antenna, the conductive element being in electrical continuity with the terminal pad of the embedded antenna to transmit signals to or from the embedded antenna during operation.

7. The system of claim 6, wherein the antenna is printed on one of the layers of the multi-layer material.

8. The system of claim 6, wherein the antenna is configured to receive signals in a radiofrequency range.

9. The system of claim 6, further comprising a conductive layer extending along the conductive element intermediate the conductive element and the terminal pad of the antenna to place the conductive element and the terminal pad of the antenna in electrical continuity.

10. The system of claim 9, wherein the conductive layer comprises a conductive epoxy or grease.

11. The system of claim 6, wherein the conductive element extends completely thorough all layers of the multi-layer material.

12. The system of claim 6, wherein the conductive element is expandable to exert a pressure against the multi-layer material when installed therein.

13. The system of claim 6, wherein the conductive element is hollow.

14. The system of claim 6, further comprising a tuning circuit coupled to the conductive element for tuning the antenna to a desired frequency.

15. An embedded antenna system comprising:

a multi-layer material including a plurality of interior surfaces and an exterior surface, wherein the multi-layer material is a laminate comprising at least one phenolic impregnated layer and at least one melamine impregnated layer;

an embedded antenna disposed intermediate two of the interior surfaces, the antenna having a terminal pad; and a conductive element disposed adjacent to the exterior surface and coupled to the terminal pad to transmit signals to or from the embedded antenna during operation.

16. The system of claim 15, wherein the conductive element is mechanically coupled to the terminal pad.

17. The system of claim 16, wherein the conductive element extends from the exterior surface of the multi-layer material through at least a portion of the multi-layer material and through the terminal pad of the embedded antenna, the conductive element having electrical continuity with the terminal pad of the embedded antenna.

18. The system of claim 17, further comprising a conductive layer extending along the conductive element intermediate the conductive element and the terminal pad of the antenna to place the conductive element and the terminal pad of the antenna in electrical continuity.

19. The system of claim 18, wherein the conductive layer comprises a conductive epoxy or grease.

20. The system of claim 17, wherein the conductive element extends completely thorough all layers of the multi-layer material.

21. The system of claim 17, wherein the conductive element is expandable to exert a pressure against the multi-layer material when installed therein.

22. The system of claim 17, wherein the conductive element is hollow.

23. The system of claim 15, wherein the conductive element is capacitively coupled to the terminal pad.

24. The system of claim 23, wherein the conductuve element and the terminal pad form a capacitor having a dielectric layer defined by one or more layers of the multi-layer material interposed therebetween.

25. The system of claim 15, wherein the antenna is printed on one of the layers of the multi-layer material.

26. The system of claim 15, wherein the antenna is configured to receive signals in a radiofrequency range.

27. A method for transmitting signals between an antenna embedded in a multi-layer material and external circuitry, the method comprising:

forming an aperture in the multi-layer material from an exterior surface thereof and extending at least through a terminal area of the embedded antenna;

inserting a conductive terminal element into the aperture to place the terminal element in electrical continuity with the antenna; and disposing a conductive fluid intermediate an interior surface of the aperture and the conductive terminal element to place the terminal element in electrical continuity with the antenna.

28. The method of claim 27, comprising urging the terminal element outwardly to place the conductive fluid under pressure.

29. The method of claim 27, wherein the conductive fluid is a conductive epoxy or grease.

30. The method of claim 27, further comprising forming the antenna between two layers of the multi-layer material.

31. The method of claim 30, wherein the antenna is printed on one of the layers of the multi-layer material.

32. A method for transmitting signals between an antenna embedded in a multi-layer material and external circuitry, the method comprising:

disposing a conductive terminal element onto a terminal region of a multi-layer material;

coupling the conductive terminal element with a terminal pad of the antenna to transmit signals to or from the embedded antenna during operation; and wherein the conductive element is capacitively coupled to the terminal pad.

33. An embedded antenna system comprising:

a multi-layer material including a plurality of interior surfaces and an exterior surface, wherein the multi-layer material is a laminate comprising at least one phenolic impregnated layer and at least one melamine impregnated layer;

an embedded antenna disposed intermediate two of the interior surfaces, the antenna having a terminal pad;

a conductive element disposed adjacent to the exterior surface and coupled to the terminal pad to transmit signals to or from the embedded antenna during operation; and wherein the conductive element is capacitively coupled to the terminal pad.

* * * * *